United States Patent [19]

Germ

[11] Patent Number: 4,906,202

[45] Date of Patent: Mar. 6, 1990

[54] DEEP WELL IGNITION CABLE TERMINAL ASSEMBLY

[75] Inventor: Kenneth B. Germ, Niles, Ohio

[73] Assignee: General Motors Corporation, Detroit, Mich.

[21] Appl. No.: 322,472

[22] Filed: Mar. 13, 1989

[51] Int. Cl.[4] ..... H01R 13/52

[52] U.S. Cl. ..... 439/127; 439/125

[58] Field of Search ..... 439/125, 127, 128, 736, 439/869, 890, 893

[56] References Cited

U.S. PATENT DOCUMENTS

| | | | |
|---|---|---|---|
| 3,914,003 | 10/1975 | Loy | 439/125 X |
| 4,267,811 | 5/1981 | Springer | 123/432 |
| 4,319,799 | 3/1982 | Pearce | 339/217 |
| 4,390,231 | 6/1983 | Plyler et al. | 339/217 |
| 4,637,358 | 1/1987 | Yano et al. | 123/169 PA |
| 4,701,662 | 10/1987 | Yamanaski et al. | 313/51 |
| 4,810,198 | 3/1989 | Sturdevan | 439/125 |
| 4,824,385 | 4/1989 | Sturdevan | 439/128 |

FOREIGN PATENT DOCUMENTS 2730084 1/1979 Fed. Rep. of Germany ..... 439/125

OTHER PUBLICATIONS

Exhibit A which shows a spark plug apparatus.
Exhibit B which shows a concept drawing of Illmor Engineering of Brixworth, England.

*Primary Examiner*—Eugene F. Desmond
*Attorney, Agent, or Firm*—F. J. Fodale

[57] ABSTRACT

An ignition cable terminal assembly comprises an elongated hard plastic pipe which has an elastomeric head cover and an elastomeric seal sleeve. The elastomeric head cover has a handle portion which is reinforced by conformations at the top of the hard plastic pipe so that the elastomeric head cover is not damaged when the assembly is pushed on or pulled off a spark plug. The lower end of the hard plastic pipe has an internal shoulder and a pull bar which engage the ignition terminal housed in the pipe so that the electrical and mechanical connection between the ignition terminal and the ignition cable is not stressed when the assembly is pushed on or pulled off the spark plug.

3 Claims, 2 Drawing Sheets

DEEP WELL IGNITION CABLE TERMINAL ASSEMBLY

Background of the Invention

This invention relates generally to ignition cable terminal assemblies and more particularly to ignition terminal assemblies which are adapted for connection to spark plugs which are located in deep recesses or wells in an internal combustion engine.

U.S. Pat. No. 4,637,358 which was granted to Yoshiki Yano and Toshihiro Oikawa on Jan. 20, 1987 discloses a ignition cable terminal assembly or spark plug cap apparatus which is adapted for connection to a spark plug which is located in a deep well or elongated spark plug bore of an internal combustion engine. This prior art spark plug apparatus comprises a spark plug cap pipe which houses a terminal attached to the end of an ignition cable which extends through an elastomeric head cover at the upper end of the pipe.

The head cover which is bonded to the upper end of the pipe by a boss, includes a handle portion. The handle portion has two functions. First the handle portion provides the means for the user to grip the ignition cable terminal assembly for manually connecting or disconnecting the terminal assembly to or from the spark plug terminal. Secondly the handle portion bends and redirects the ignition cable from a vertical orientation in the pipe to a generally horizontal orientation at the exit of the head cover.

The pipe also has a bush or seal sleeve at the lower end which sealingly engages the insulator of the spark plug when the ignition cable terminal assembly is connected to the spark plug terminal.

SUMMARY OF THE INVENTION

The object of this invention is to provide an improved ignition cable terminal assembly of the type which is disclosed in the patent which is described above.

One feature of the invention is that the handle portion of the elastomeric head is reinforced with portions of the hard plastic pipe so that the engagement and disengagement forces applied by the user are transferred to the pipe member without imparting any appreciable stress to the elastomeric head which would tend to stretch or tear the elastomeric head.

Another feature of the invention is that the ignition cable terminal assembly includes means to transfer both the engagement and disengagement forces from the hard plastic pipe to the ignition terminal without imparting any appreciable stress to the electrical and mechanical connection between the ignition terminal and the ignition cable.

Yet another feature of the invention is that the ignition cable terminal assembly includes a pull bar which transfers the disengagement force from the pipe to the ignition terminal so that the ignition cable terminal assembly can be pulled off the spark plug terminal without imparting any appreciable stress to the electrical and mechanical connection between the ignition terminal and the ignition cable.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
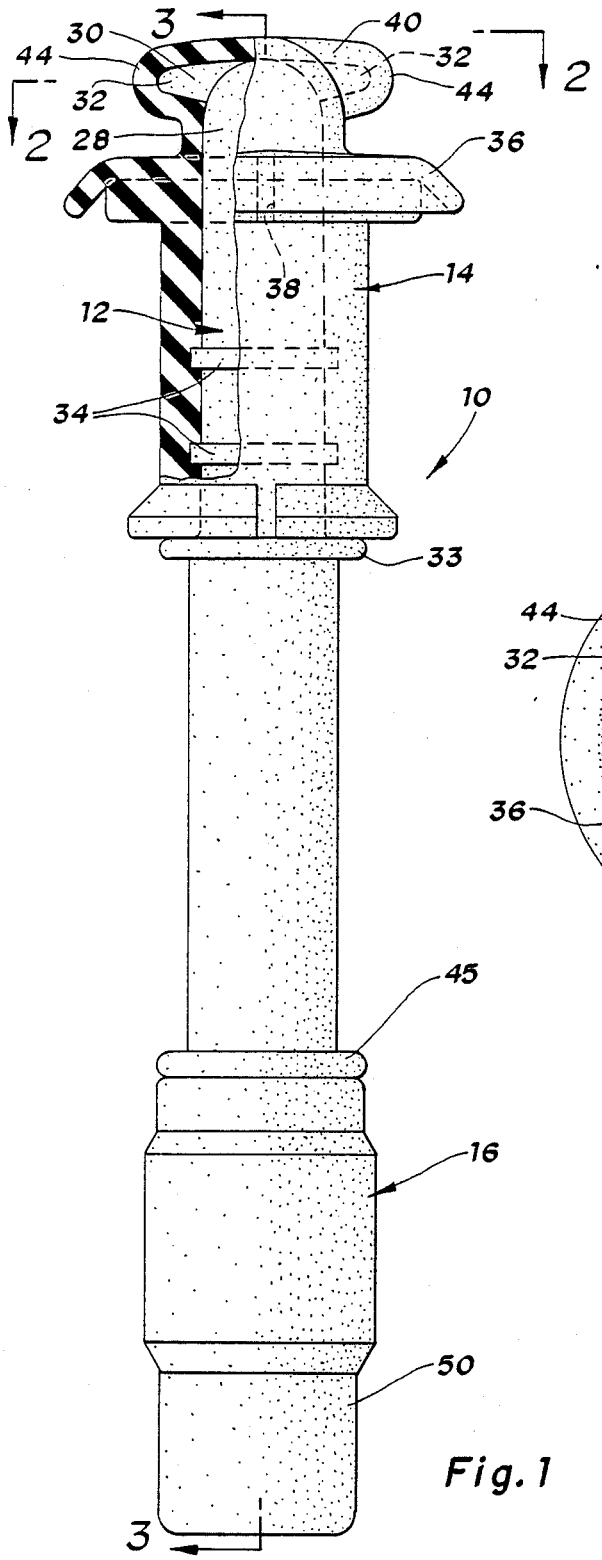
FIG. 1 is front elevation view of an ignition cable terminal assembly in accordance with the invention.

Referring now to the drawing, an ignition cable terminal assembly for connecting an ignition cable to the terminal of a spark plug (not shown) located in a deep well or recess in an internal combustion engine (not shown) is indicated generally at 10. The ignition cable terminal assembly 10 comprises an elongated pipe 12 of hard plastic material, such as nylon or other suitable relatively rigid thermoplastic material, an elastomeric head cover 14 of hypalon or the like, an elastomeric seal sleeve 16 of silicone or other rubber-like material, and a hard plastic pull bar 18.

The elongated pipe 12 houses an ignition terminal 20 which has a conventional corrugated crimp barrel 22 which attaches the ignition terminal 20 to an end of an ignition cable 24 in a conventional manner. The ignition terminal 20 is attached to the ignition cable 24 below the elongated pipe 12 and then "pulled to seat" against an internal shoulder 26 in the lower end of the elongated pipe 12 through the bottom opening of the pipe. The ignition terminal 20 is pulled to seat by means of the ignition cable 24 which extends out of the top opening of the elongated pipe 12.

The elongated pipe 12 has a curved wall 28 at its upper end which bends and redirects the ignition cable 24 from a vertical orientation in the elongated pipe 12 to a generally horizontal orientation at the top opening. The upper end of the curved wall 28 has a top plate 30 which provides a pair of laterally extending wings 32 for reinforcing a handle portion of the elastomeric head cover 14 as explained below.

Figure 3:
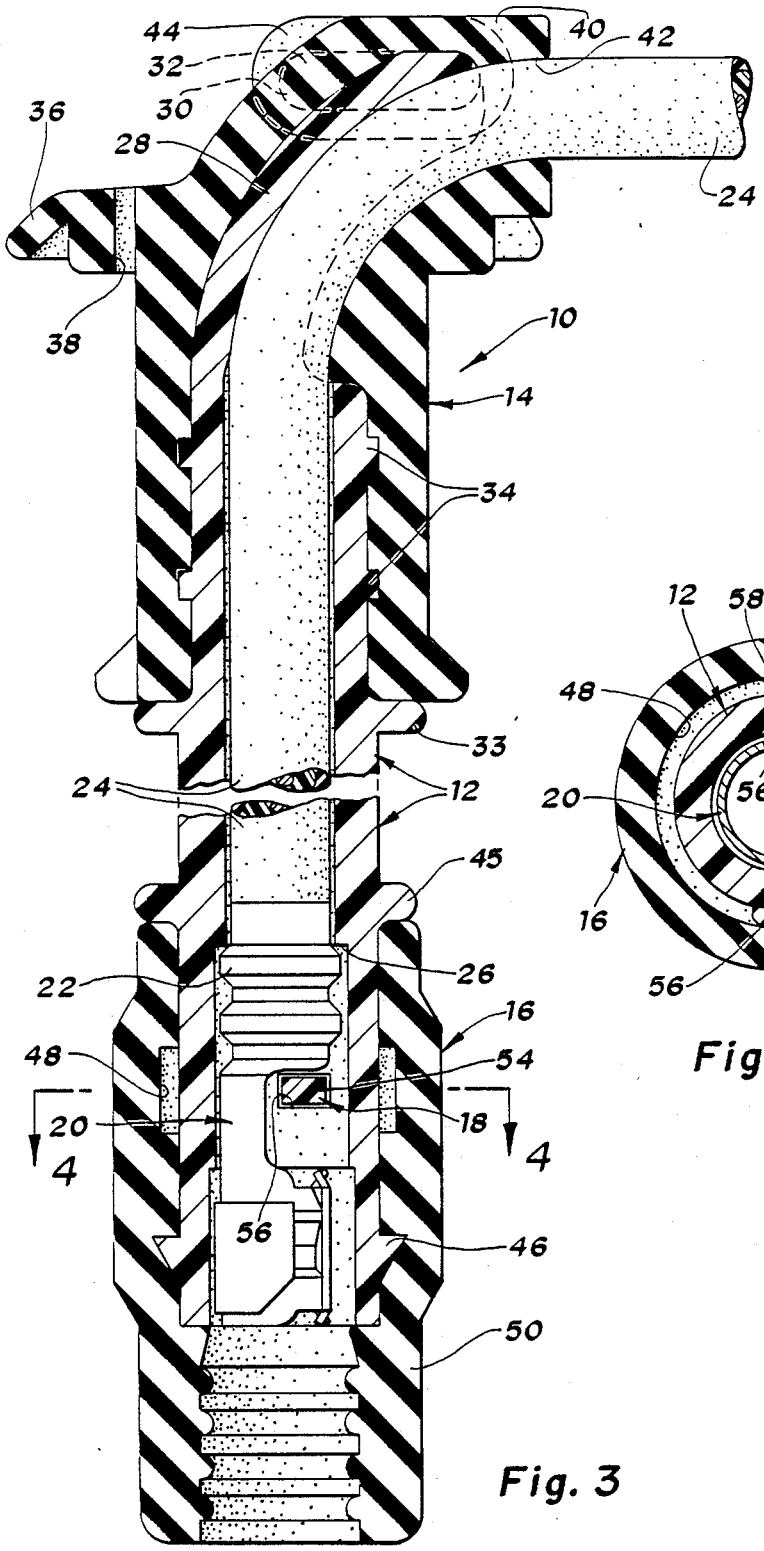
FIG. 3 is a sectional view of the ignition cable terminal assembly taken substantially along the line 3—3 of FIG. 1 looking in the direction of the arrows.

The upper portion of the elongated pipe 12 has an external flange 33 and two external ribs 34 which are used to locate and secure the head cover 14 to the elongated pipe 12 as shown in FIG. 3. The elastomeric head cover 14 has an annular seal flange 36 which seals the top of the engine well(not shown) in which the spark plug is seated when the ignition terminal assembly 10 is connected to the terminal of the spark plug. The annular seal flange 36 may also include a vent hole 38.

The elastomeric head cover 14 also includes a handle portion 40 and a seal aperture 42 which are above the annular seal flange 36. The handle portion 40 is gripped by the user to connect or disconnect the ignition terminal assembly 10 to or from the terminal of the spark plug. The seal aperture 42 seals around the cable 26 behind the top opening of the elongated pipe 12.

Figure 2:
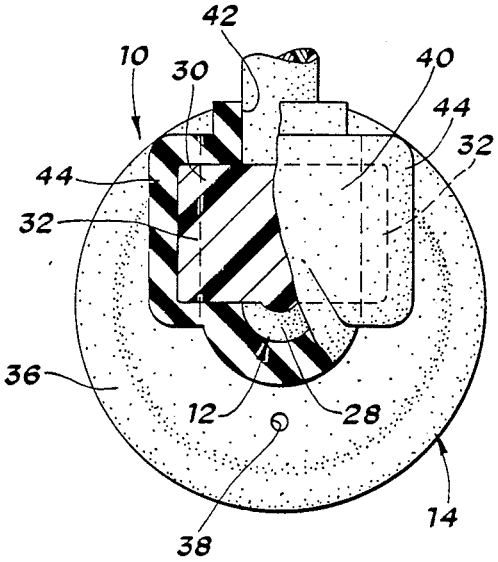
FIG. 2 is a top view of the ignition cable terminal assembly taken substantially along the line 2—2 of FIG. 1 looking in the direction of the arrows.

The handle portion 40 of the elastomeric head cover 14 has two wing portions 44 which are spaced above the annular seal flange 36 as best seen in FIGS. 1 and 2. This shape permits the user to grip the handle portion 40 by inserting his index finger and his forefinger under the two respective wing portions 44 and pressing down on the top of the handle portion 40 with his thumb. Thus gripped, the terminal assembly 10 is easily pushed down onto the spark plug or pulled off.

The handle portion 40 of the elastomeric head cover 14 is reinforced by the top plate 30 of the hard plastic pipe 12 which has its laterally extending wings 32 embedded in the two wing portions 44 of the handle portion 40. Consequently, the forces applied to the handle portion 40 by the user when connecting or disconnecting the ignition cable terminal assembly 10 are transferred from the handle portion 40 of the elastomeric head cover 14 immediately and directly to the top of the hard plastic pipe 12 via the top plate 30. Thus any stress which tends to stretch and tear the elastomeric head cover 14 is essentially avoided.

The lower portion of the elongated hard plastic pipe 14 has an external flange 45 and an external rib 46 which locate and retain the seal sleeve 16 on the lower end of the plastic pipe 12. The seal sleeve 16 has an internal groove 48 which accommodates external portions of the pull bar 18 and an internally ribbed end portion 50 which extends below the plastic tube 12 and sealingly engages the insulator of the spark plug (not shown) when the ignition cable terminal assembly 10 is connected to the spark plug.

Figure 4:
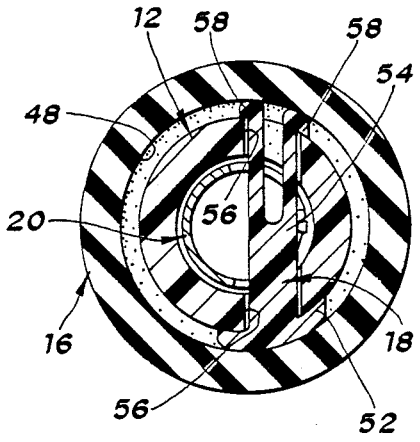
FIG. 4 is a sectional view of the ignition cable terminal assembly taken substantially along the line 4—4 of FIG. 3 looking in the direction of the arrows.

The pull bar 18 as best shown in FIGS. 3 and 4 has a head 52 which is disposed in the groove 48 of the seal sleeve 16 and a shank 54 which extends transversely through a lower end portion of the elongated pipe 12 through holes 56 which are located below the internal shoulder 26. The shank 54 engages the lower end of the crimp barrel 22 of the ignition terminal 20 so the disengagement force is transferred from the elongated pipe to the pull bar 18 to the ignition terminal 20 when the ignition cable terminal assembly 10 is pulled off the spark plug. On the other hand the engagement force is transferred from the elongated pipe 12 directly to the ignition terminal 20 via the internal shoulder 26 when the ignition cable terminal assembly 10 is pushed onto the spark plug.

The end of the shank 54 is bifurcated and provided with lock nibs 58 which retain the pull bar 18 in the absence of the seal sleeve 16. When the seal sleeve 16 is assembled to the lower end of the elongated pipe 12, the bifurcated ends of the pull bar 18 extend into the groove 48 as shown in FIG. 4.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An ignition cable terminal assembly for connecting an ignition cable to a spark plug terminal which is located in a deep well in an internal combustion engine comprising:

an elongated pipe of hard plastic material which houses an ignition terminal which is attached to an end of an ignition cable which extends out of a top opening of the elongated pipe, an elastomeric head cover which is mounted on an upper portion of the elongated pipe and which has an opening which sealingly engages around the ignition cable behind the top opening of the elongated pipe, the elastomeric head cover having a handle portion which is gripped by a user to connect or disconnect the ignition cable terminal assembly to or from the spark plug terminal, and the elongated plastic pipe having reinforcements at its upper end which are embedded in the handle portion of the elastomeric head cover whereby engagement and disengagement forces applied to the handle portion by the user are transferred to the hard plastic pipe without any appreciable stress being applied to the elastomeric head cover which would tend to stretch or tear the elastomeric head cover.

2. An ignition cable terminal assembly for connecting an ignition cable to a spark plug terminal which is located in a deep well in an internal combustion engine coprising:

an elongated pipe of hard plastic material which houses an ignition terminal which is attached to an end of an ignition cable which extends out of a top opening of the elongated pipe, an elastomeric head cover which is mounted on an upper portion of the elongated pipe and which has an opening which sealing engages around the ignition cable behind the top opening of the elongated pipe, the elastomeric head cover having an annular seal flange and a handle portion above the annular seal flange which is gripped by a user to connect or disconnect the ignition cable terminal assembly to or from the spark plug terminal, the handle potion having laterally extending wings which are spaced vertically from the annular seal flange, the elongated plastic pipe having a curved wall at its upper end which bends and redirects the ignition cable from a vertical orientation in the elongated pipe to a generally horizontal orientation at the top opening of the elongated pipe, and the curved wall having a top plate which includes reinforcement wings which are embedded in the laterally extending wings of the handle portion of the elastomeric head cover whereby engagement and disengagement forces applied to the handle portion by the user are transferred immediately and directly to the top of the hard plastic pipe whereby any stress which tends to stretch or tear the elastomeric cover is essentially avoided.

3. An ignition cable terminal assembly for connecting an ignition cable to a spark plug terminal which is located in a deep well in an internal combustion engine comprising:

an elongated pipe of hard plastic material which houses an ignition terminal which is attached t o an end of an ignition cable which extends out of a top opening of the elongated pipe, an elastomeric head cover which is mounted on an upper portion of the elongated pipe and which has an opening which sealingly engages around the ignition cable behind the top opening of the elongated pipe, the elastomeric head cover having a handle portion which is gripped by a user to connect or disconnect the ignition cable terminal assembly to or from the spark plug terminal, the elongated pipe having reinforcements at its upper end which are embedded in the handle portion of the elastomeric head cover whereby engagement and disengagement forces applied to the handle portion by the user are transferred to the hard plastic pipe without any appreciable stress being applied to the elastomeric head cover, which tend to stretch and tear the head cover, the hard plastic pipe having an internal shoulder which engages a portion of the ignition terminal when the ignition cable terminal assembly is pushed onto the spark plug terminal, and a pull bar which extends transversely through a lower end portion of the elongated pipe below the internal shoulder for engaging a portion of the ignition terminal and transferring the disengagement force from the elongated pipe to the ignition terminal when the ignition cable terminal assembly is pulled off the spark plug terminal.

* * * * *